US005120108A

United States Patent [19]

Watson et al.

[11] Patent Number: 5,120,108

[45] Date of Patent: Jun. 9, 1992

[54] CONVERTIBLE SEAT CUSHION/TOTE BAG FOR SKATES

[76] Inventors: John Watson, P.O. Box 1029, Red Deer, AB, Canada, T4N 6S5; George Spector, 233 Broadway RM 3815, New York, N.Y. 10007

[21] Appl. No.: 658,333

[22] Filed: Feb. 20, 1991

[51] Int. Cl.[5] ..... A47C 7/62

[52] U.S. Cl. ..... 297/188; 297/129; 383/4; 383/76; 206/315.1; 5/462

[58] Field of Search ..... 297/188, 217, 219, 452, 297/129, 118; 5/462, 465; 206/315.1, 315.9, 315.91, 315.11; 383/72, 74, 75, 76, 38, 39, 40, 4; 280/816, 814, 811; 190/1, 8

[56] References Cited

U.S. PATENT DOCUMENTS

| | | | |
|---|---|---|---|
| 1,683,678 | 9/1928 | Kitterman et al. | 383/40 X |
| 2,712,337 | 7/1955 | Tremblay | 280/811 X |
| 2,865,433 | 12/1985 | Warner | 383/4 X |
| 3,763,972 | 10/1973 | Karzmar | 383/4 X |
| 3,825,298 | 7/1974 | Chipman | 383/76 X |
| 4,063,003 | 9/1989 | Carter | 297/217 |
| 4,126,256 | 11/1978 | McGruder | 383/38 X |
| 4,687,248 | 8/1987 | Ross et al. | 297/188 X |
| 4,789,247 | 12/1988 | Schnoor | 383/76 X |
| 4,924,948 | 7/1990 | Vickers | 297/118 |
| 4,984,906 | 1/1991 | Little | 383/40 X |
| 5,002,401 | 3/1991 | Blackman | 383/38 |

FOREIGN PATENT DOCUMENTS

| | | | |
|---|---|---|---|
| 120640 | 1/1931 | Australia | 280/814 |
| 1071540 | 6/1967 | United Kingdom | 383/76 |

*Primary Examiner*—Joseph Falk
*Assistant Examiner*—James M. Gardner

[57] ABSTRACT

A combination seat, equipment holder and ice skate protector device is provided and consists of a first cushioned panel hinged to a second storage panel having a plurality of pockets which is hinged to a third padded panel. The first cushioned panel is placed upon a dressing room bench so that an ice skater can sit in comfort. The second storage panel hangs down in front of the dressing room bench, so that the pockets can hold in an organized manner small equipment. The third padded panel sits upon the floor so that ice skates can rest upon it for protection.

1 Claim, 1 Drawing Sheet

CONVERTIBLE SEAT CUSHION/TOTE BAG FOR SKATES

BACKGROUND OF THE INVENTION

The instant invention relates generally to sporting accessories and more specifically it relates to a combination seat, equipment holder and ice skate protector device which provides comfort, organization and protection for an ice skater.

There are available various conventional sporting accessories which do not provide the novel improvements of the invention herein disclosed.

SUMMARY OF THE INVENTION

A primary object of the present invention is to provide a combination seat, equipment holder and ice skate protector device that will overcome the shortcomings of the prior art devices.

Another object is to provide a combination seat, equipment holder and ice skate protector device that will supply comfort, organization and protection for an ice skater using the device.

An additional object is to provide a combination seat, equipment holder and ice skate protector device that can be folded up so as to be used as a carry bag for shoes, ice skates and the like.

A further object is to provide a combination seat, equipment holder and ice skate protector device that is simple and easy to use.

A still further object is to provide a combination seat, equipment holder and ice skate protector device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
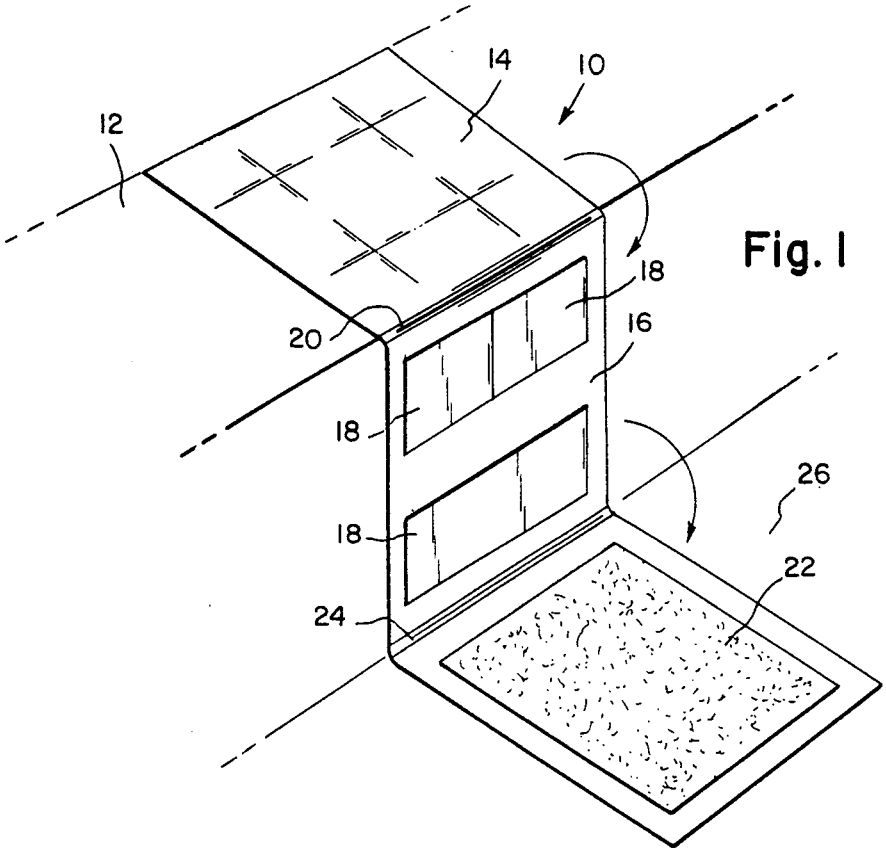
FIG. 1 is a perspective view of the instant invention installed on a dressing room bench ready to be used thereon.
Figure 2:
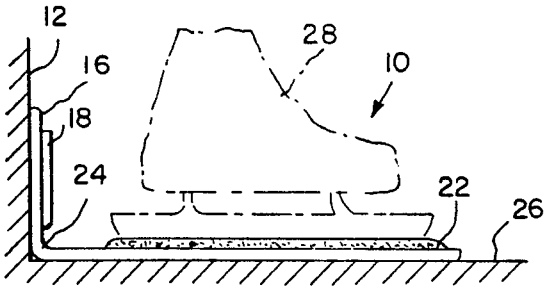
FIG. 2 is a side view thereof with parts broken away showing a skate in phantom on the padded area.
Figure 3:
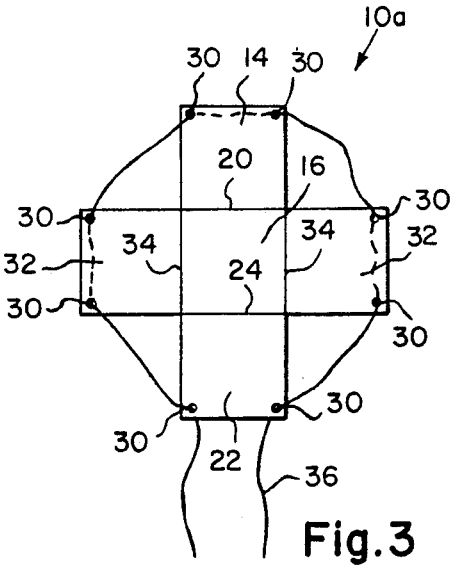
FIG. 3 is is a diagrammatic flat open plan view of a modification with a pair of extra side fold back panels and a draw string therethrough.

Turning now descriptively to the drawings, in which similar reference characters denote similar elements throughout the several views, FIGS. 1 and 2 illustrate a combination seat, equipment holder and ice skate protector device 10 for a dressing room bench 12 consisting of a first cushioned panel 14 to be placed upon the dressing room bench 12 so that an ice skater can sit in comfort on the first cushioned panel 14. A second storage panel 16 having a plurality of pockets 18 thereon is hinged at 20 to the first cushioned panel 14 to hang down in front of the dressing room bench 12 so that small equipment, such as tape, laces, pucks and the like can be placed in an organized manner within the pockets 18. A third padded panel 22 is hinged at 24 to the second storage panel 16 to sit upon the floor 26 in front of the dressing room bench 12 so that ice skates 28 can rest upon the third padded panel 22 for protection.

The first cushioned panel 14, the second storage panel 16 and the third padded panel 22 are all of the same size so that when they are folded up along the hinges 20 and 24 the device 10 can be placed in storage to be used again. The device 10 is fabricated out of a durable lightweight material so that the device 10 can be used over a long period of time and can be easily carried from place to place.

Figure 4:
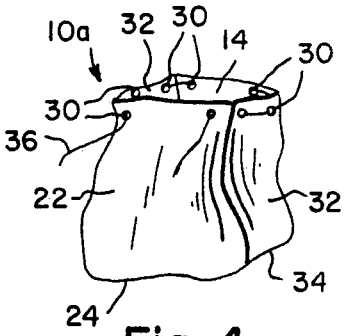
FIG. 4 is is a perspective view of the modification of FIG. 3 folded up as a carry bag for shoes, skates, etc.

A modified device **10*a* is shown in FIGS. 4 and 5, in which the first cushioned panel 14 has an eyelet 30 in each free corner and the third padded panel 22 also has an eyelet 30 in each free corner. A pair of extra side fold back panels 32 are provided with each having an eyelet 30 in each free corner. Each panel 32 is hinged at 34 to one side of the second storage panel 16. A draw string 36 extends through the eyelets 30 in the first cushioned panel 14, the third padded panel 22 and the side fold back panels 32, so that when folded up the device 10*a* can be used as a carry bag for shoes, ice skates 28** and the like.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination seat, equipment holder and ice skate protector device for a dressing room bench comprising:

a) a first cushioned panel to be placed upon the dressing room bench so that an ice skater can sit in comfort on said first cushioned panel;

b) a second storage panel having a plurality of pockets thereon, hinged to said first cushioned panel to hang down in front of the dressing room bench so that small equipment, such as tape, laces, pucks and the like can be placed in an organized manner within the pockets; and c) a third padded panel hinged to said second storage panel to sit upon the floor in front of the dressing room bench so that the ice skates can rest upon said third padded panel for protection; wherein said skate protector device is fabricated out of a durable lightweight material so that said device can be used over a long period of time and can be easily carried from place to place; further including:

d) said first cushioned panel having an eyelet in each free corner;

e) said third padded panel having an eyelet in each free corner;

f) a pair of extra side fold back panels each having an eyelet in each free corner and hinged to one side of said second storage panel; and g) a draw string extending through said eyelets in said first cushioned panel, said third padded panel and said side fold back panels so that when folded up said device can be used as a carry bag for shoes, ice skates and the like.

* * * * *